US010967493B2

(12) United States Patent
Matsuda et al.

(10) Patent No.: US 10,967,493 B2
(45) Date of Patent: Apr. 6, 2021

(54) BINDING MEMBER REMOVAL APPARATUS

(71) Applicant: PFU Limited, Ishikawa (JP)

(72) Inventors: Yuki Matsuda, Ishikawa (JP); Shigeharu Okano, Ishikawa (JP); Haruka Shimura, Ishikawa (JP)

(73) Assignee: PFU LIMITED, Ishikawa (JP)

( * ) Notice: Subject to any disclaimer, the term of this patent is extended or adjusted under 35 U.S.C. 154(b) by 75 days.

(21) Appl. No.: 16/419,362

(22) Filed: May 22, 2019

(65) Prior Publication Data

US 2019/0270189 A1 Sep. 5, 2019

Related U.S. Application Data

(63) Continuation of application No. PCT/JP2016/087807, filed on Dec. 19, 2016.

(51) Int. Cl.
*B25C 11/00* (2006.01)
*B07C 5/342* (2006.01)

(52) U.S. Cl.
CPC ..... *B25C 11/00* (2013.01); *B07C 5/3422* (2013.01)

(58) Field of Classification Search
CPC ..... B25C 11/00; B07C 5/3422
See application file for complete search history.

(56) References Cited

U.S. PATENT DOCUMENTS 6,634,633 B1 * 10/2003 Maruchi ..... B25C 11/00 254/28
8,651,473 B2 * 2/2014 Suzuki ..... B65H 7/20 270/58.33
10,640,319 B2 * 5/2020 Shiota ..... G03G 15/6541
10,701,228 B1 * 6/2020 Yoshidome ..... H04N 1/00628
2004/0022563 A1 2/2004 Maruchi et al.
2010/0067071 A1 * 3/2010 Rozenfeld ..... H04N 1/00063 358/498
2012/0251288 A1 10/2012 Suzuki et al.
2013/0168621 A1 * 7/2013 Takahashi ..... B65H 5/006 254/28

FOREIGN PATENT DOCUMENTS

JP 06-186650 A 7/1994
JP 2000-094363 A 4/2000
JP 2000-127064 A 5/2000
JP 2000-159449 A 6/2000
JP 2000-246667 A 9/2000
JP 2000-263470 A 9/2000
JP 2000263470 A * 9/2000
JP 2012-210986 A 11/2012
JP 2016-101653 A 6/2016

OTHER PUBLICATIONS

International Search Report issued in corresponding International Patent Application No. PCT/JP2016/087807, dated Mar. 21, 2017, with English Translation.

* cited by examiner

*Primary Examiner* — Patrick H Mackey
(74) *Attorney, Agent, or Firm* — McDermott Will & Emery LLP

(57) ABSTRACT

A binding member removal apparatus includes a removal unit that removes a binding member that binds a bound medium from the bound medium, an image capturing unit that captures an image in which a portion of the bound medium appears, a driving unit that moves the removal unit, and a control unit that controls the driving unit such that the removal unit is disposed at a predetermined position with respect to the binding member, on the basis of the image.

12 Claims, 15 Drawing Sheets

BINDING MEMBER REMOVAL APPARATUS

CROSS-REFERENCE TO RELATED APPLICATION

This application is a continuation of International Application No. PCT/JP2016/087807, filed on Dec. 19, 2016, the entire contents of which are incorporated herein by reference.

FIELD

The embodiments discussed herein are related to a binding member removal apparatus.

BACKGROUND

A plurality of paper documents bound with a binder are often computerized by a scanner device. The paper documents bound with the binder may include a bound medium that is bound with a staple or a clip. If such a bound medium is inserted as it is in the scanner device, the bound medium may be damaged or the scanner device may be broken. Therefore, it is determined whether the documents to be inserted in the scanner device are bound with a staple, and if the staple is detected, the staple is removed and thereafter the documents are inserted in the scanner device. Some devices that automatically detect a position of a staple and automatically remove the staple have been known (see Japanese Laid-open Patent Publication No. 06-186650, Japanese Laid-open Patent Publication No. 2000-159449, and Japanese Laid-open Patent Publication No. 2012-210986).

However, the devices as described above capture an image of the entire bound medium. Therefore, it is necessary to use a relatively large image capturing unit or ensure a large distance between the image capturing unit and a sheet, so that a size of the apparatus is increased.

SUMMARY

According to an aspect of an embodiment, a binding member removal apparatus includes a removal unit that removes a binding member that binds a bound medium from the bound medium, an image capturing unit that captures an image in which a portion of the bound medium appears, a driving unit that moves the removal unit, and a control unit that controls the driving unit such that the removal unit is disposed at a predetermined position with respect to the binding member, on the basis of the image.

The object and advantages of the disclosure will be realized and attained by means of the elements and combinations particularly pointed out in the claims.

It is to be understood that both the foregoing general description and the following detailed description are exemplary and explanatory and are not restrictive of the disclosure.

DESCRIPTION OF EMBODIMENTS

Preferred embodiments of the disclosure will be explained with reference to accompanying drawings. Exemplary embodiments of a binding member removal apparatus disclosed in the present application will be described below with reference to the drawings. The disclosed technology is not limited by the description below. Further, in the following description, the same components are denoted by the same reference signs, and the same explanation will be omitted.

First Embodiment

Binding Member Removal Apparatus

Figure 1:
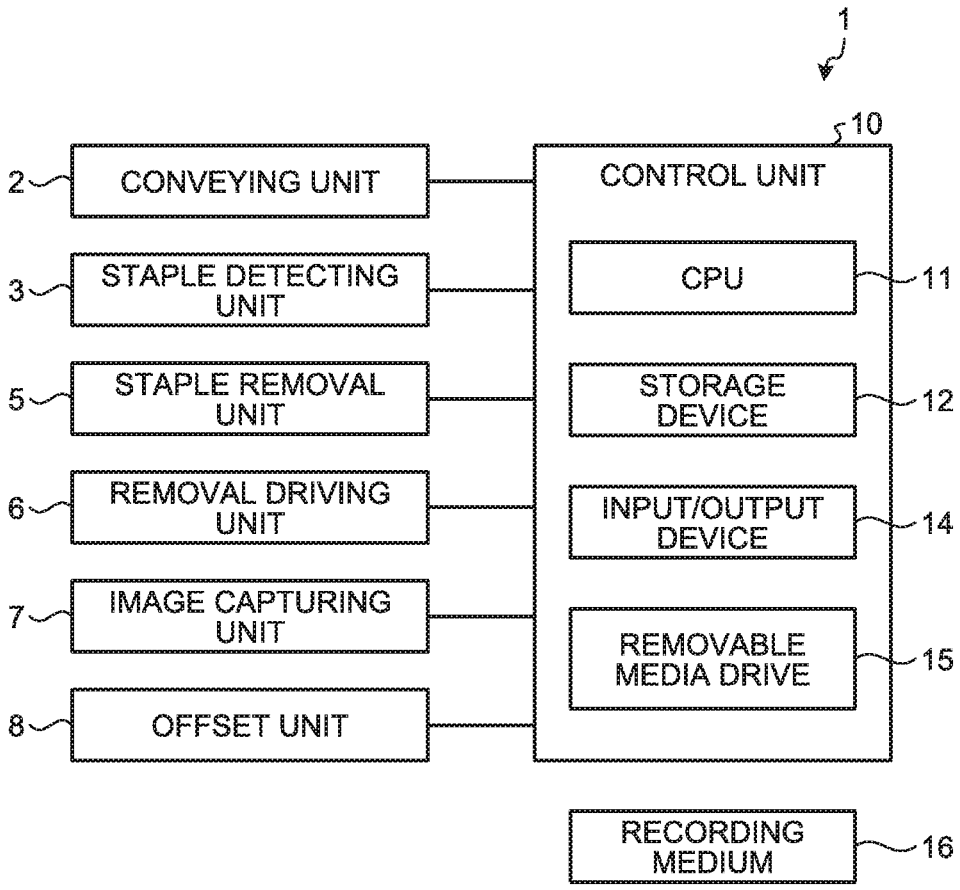
FIG. 1 is a block diagram illustrating a binding member removal apparatus of a first embodiment.

FIG. 1 is a block diagram illustrating a binding member removal apparatus 1 of a first embodiment. As illustrated in FIG. 1, the binding member removal apparatus 1 of the first embodiment includes a conveying unit 2, a staple detecting unit 3, a staple removal unit 5, a removal driving unit 6, an image capturing unit 7, an offset unit 8, and a control unit 10. The conveying unit 2 includes a shooter, a stacker, a conveying guide, and a plurality of conveying rollers (all of which are not illustrated). The shooter includes a mounting surface on which a plurality of media is placed. The stacker includes a mounting surface on which a plurality of media is placed. The conveying guide forms a conveying path that connects the mounting surface of the shooter and the mounting surface of the stacker. The conveying path is fixed to a setting surface when the binding member removal apparatus 1 is set on the setting surface. The conveying rollers are controlled by the control unit 10 so as to convey a medium along the conveying path formed by the conveying guide.

The staple detecting unit 3 is arranged in the middle of the conveying path that is formed by the conveying unit 2. The staple detecting unit 3 is controlled by the control unit 10 so as to detect irregularities on a front side of a medium that is conveyed through the conveying path of the conveying unit 2, and further detect whether the medium is a bound medium that is bound with a staple on the basis of the irregularities. Further, the staple detecting unit 3 is controlled by the control unit 10 so as to detect a binding region of the bound medium in which the bound medium is bound with the staple. The binding region is detected so as to indicate only a portion of the bound medium in which the bound medium is bound with the staple, instead of indicating the entire bound medium.

The staple removal unit 5 is arranged on the downstream side of the staple detecting unit 3 in the conveying path formed by the conveying unit 2, and arranged between the staple detecting unit 3 and the stacker of the conveying unit 2 in the conveying path. The staple removal unit 5 is controlled by the control unit 10 so as to remove the staple from the bound medium that is conveyed through the conveying path formed by the conveying unit 2. The removal driving unit 6 is controlled by the control unit 10 so as to move the staple removal unit 5 such that the staple removal unit 5 can appropriately remove the staple from the bound medium that is conveyed through the conveying path formed by the conveying unit 2. The image capturing unit 7 is controlled by the control unit 10 so as to capture an image, in which a partial region of the conveying path formed by the conveying unit 2 appears.

The offset unit 8 is arranged on the downstream side of the staple removal unit 5 in the conveying path formed by the conveying unit 2, and arranged between the staple removal unit 5 and the stacker of the conveying unit 2 in the conveying path. The offset unit 8 is controlled by the control unit 10 so as to place the medium, which is conveyed by the conveying unit 2, on the mounting surface of the stacker of the conveying unit 2 by shifting the medium in the horizontal direction, or place the medium on the mounting surface of the stacker of the conveying unit 2 without shifting the medium in the horizontal direction.

The control unit 10 is a computer, and includes a central processing unit (CPU) 11, a storage device 12, an input/output device 14, and a removable media drive 15. The CPU 11 performs information processing and controls the storage device 12, the input/output device 14, and the removable media drive 15 by executing a computer program installed in the control unit 10. The CPU 11 further controls the conveying unit 2, the staple detecting unit 3, the staple removal unit 5, the removal driving unit 6, the image capturing unit 7, and the offset unit 8 by executing the computer program. The storage device 12 records therein the computer program and information used by the CPU 11. As the storage device 12, for example, a memory, such as a random access memory (RAM) or a read only memory (ROM), a fixed disk device, such as a hard disk, a solid state drive (SSD), and/or an optical disk. The input/output device 14 is, for example, a touch panel, outputs information generated by user operation to the CPU 11, and outputs information generated by the CPU 11 such that the user can recognize the information. The removable media drive 15 is configured such that a non-temporary material recording medium 16 can be attached. Examples of the recording medium 16 include a memory card, a universal serial bus (USB) memory, a secure digital (SD) card, a flexible disk, a magneto optical disk, a ROM, an erasable programmable read only memory (EPROM), an electrically erasable programmable read only memory (EEPROM), a compact disc-ROM (CD-ROM), an MO, a digital versatile disc (DVD), and a Blu-ray (registered trademark) disc. The removable media drive 15 is controlled by the CPU 11 so as to read information recorded in the recording medium 16 when the recording medium 16 is attached thereto. Meanwhile, the computer program installed in the control unit 10 may be a computer program that is read from the recording medium 16 via the removable media drive 15.

The control unit 10 controls the conveying unit 2 such that the medium is conveyed to the conveying path formed by the conveying unit 2. The control unit 10 controls the staple detecting unit 3 such that the medium conveyed through the conveying path of the conveying unit 2 is a bound medium. The control unit 10 further controls the staple detecting unit 3 such that the binding region of the bound medium in which the bound medium is bound with the staple is detected. The control unit 10 controls the image capturing unit 7 such that the image, in which the partial region of the conveying path appears, is captured. The control unit 10 controls the removal driving unit 6 such that the staple removal unit 5 is disposed at a predetermined position. The control unit 10 controls the staple removal unit 5 such that the staple is removed from the bound medium that is conveyed through the conveying path. The control unit 10 controls the offset unit 8 such that the medium, which is conveyed by the conveying unit 2, is placed on the mounting surface of the stacker of the conveying unit 2 by being shifted in the horizontal direction, or the medium is placed on the mounting surface of the stacker of the conveying unit 2 without being shifted in the horizontal direction.

Meanwhile, the CPU 11 may be configured with a different control circuit that integrally controls the control unit 10. Examples of the control circuit include a material controller, such as a graphics processing unit (GPU), a digital signal processor (DSP), a large scale integration (LSI), an application specific integrated circuit (ASIC), and a field-programmable gate array (FPGA).

Figure 2:
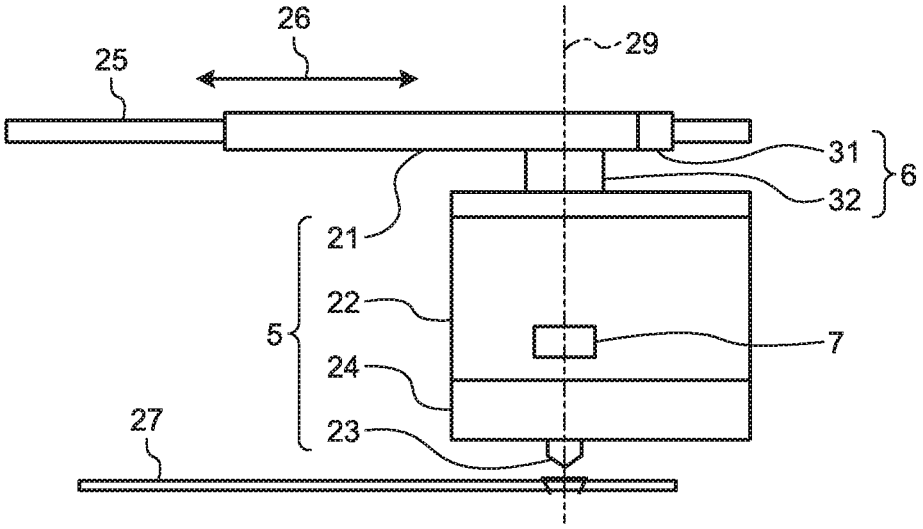
FIG. 2 is a front view illustrating a staple removal unit, a removal driving unit, and an image capturing unit.
Figure 3:
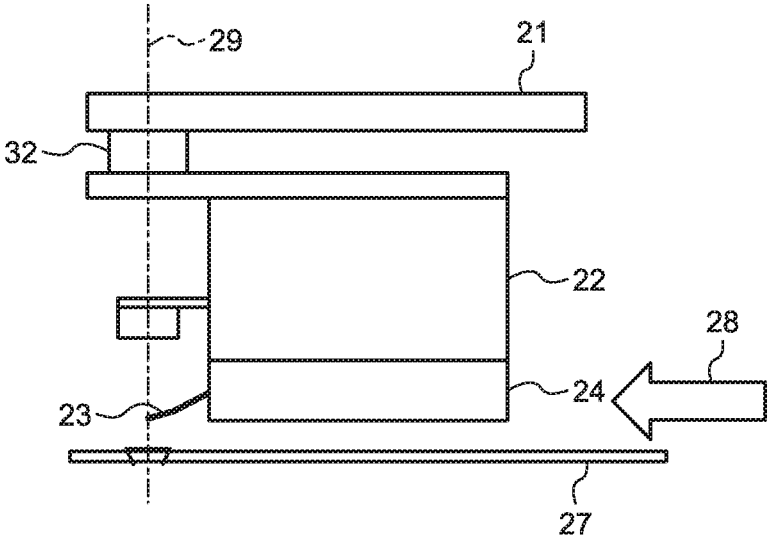
FIG. 3 is a side view illustrating the staple removal unit, the removal driving unit, and the image capturing unit.

FIG. 2 is a front view illustrating the staple removal unit 5, the removal driving unit 6, and the image capturing unit 7. FIG. 3 is a side view illustrating the staple removal unit 5, the removal driving unit 6, and the image capturing unit 7. As illustrated in FIG. 2, the staple removal unit 5 includes a first supporting unit 21, a second supporting unit 22, a removal claw 23, and a removal claw actuator 24. The first supporting unit 21 is supported by a shaft 25 so as to be able to move parallel to a left-right direction 26. The shaft 25 is fixed to the setting surface when the binding member removal apparatus 1 is set on the setting surface. The left-right direction 26 is parallel to a surface of a bound medium 27 that is conveyed by the conveying unit 2, and perpendicular to a conveying direction 28 (see FIG. 3) in which the bound medium 27 is conveyed by the conveying unit 2.

The second supporting unit 22 is supported by the first supporting unit 21 so as to be able to rotate about a rotation axis 29. The rotation axis 29 is fixed to the first supporting unit 21, and perpendicular to the surface of the bound medium 27 conveyed by the conveying unit 2. The removal claw 23 is in the form of a thin plate, and supported by the second supporting unit 22 so as to be able to move near the rotation axis 29. The removal claw actuator 24 is controlled by the control unit 10 so as to move the removal claw 23 with respect to the second supporting unit 22.

The removal driving unit 6 includes a translation driving device 31 and a rotation driving device 32. The translation driving device 31 is controlled by the control unit 10 so as to move the first supporting unit 21 parallel to the left-right direction 26 with respect to the shaft 25. The rotation driving device 32 is controlled by the control unit 10 so as to rotate the second supporting unit 22 about the rotation axis 29 with respect to the first supporting unit 21.

The image capturing unit 7 is arranged so as to cross the rotation axis 29. The image capturing unit 7 is arranged so as to capture an image in which a portion of the surface of the bound medium 27 conveyed by the conveying unit 2 and a tip of the removal claw 23 appear. The image capturing unit 7 is supported by the second supporting unit 22 and fixed to the second supporting unit 22.

Figure 4:
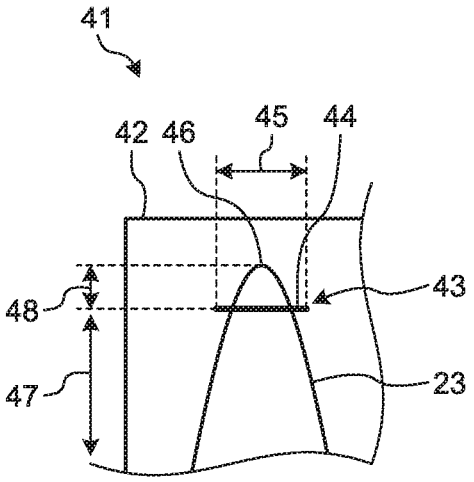
FIG. 4 is a plan view illustrating a bound medium and a removal claw.

FIG. 4 is a plan view illustrating a bound medium 41 and the removal claw 23. As illustrated in FIG. 4, the bound medium 41 includes a plurality of sheets 42 and a staple 43. Each of the sheets 42 is made with paper. The staple 43 is made with a metal needle. The staple 43 includes a front portion 44, two tip portions (not illustrated), and two penetrating portions (not illustrated). The front portion 44 has a linear shape with a predetermined staple length 45, and is arranged along a front surface of the sheets 42. The two tip portions are formed of both ends of the staple 43, and are arranged along a back surface of the sheets 42. The two penetrating portions are formed so as to connect the front portion 44 and the two tip portions, and penetrate through the sheets 42 from the front surface to the back surface. The staple 43 is formed as described above by plastic deformation. With this formation, the staple 43 binds the sheets 42 such that the staple 43 is prevented from coming off from the sheets 42 and the sheets 42 are not loosened.

The removal claw 23 is in the form of a plate that is tapered such that a width is gradually reduced toward a tip 46. The removal claw 23 is used to remove the staple 43 from the bound medium 41. In other words, the removal claw 23 is first disposed such that the removal claw 23 is arranged along the front surface of the sheets 42 and such that a longitudinal direction 47 of the removal claw 23 becomes perpendicular to a straight line along which the front portion 44 of the staple 43 is arranged. Further, the removal claw 23 is disposed such that the tip 46 is oriented toward a center of the front portion 44 of the staple 43 and the tip 46 is oriented toward a gap between the front portion 44 of the staple 43 and the sheets 42. Furthermore, the removal claw 23 is inserted in a gap between the front surface of the sheets 42 and the staple 43 from the tip 46 by being moved parallel to the longitudinal direction 47. By moving the removal claw 23 away from the sheets 42 while the removal claw 23 is inserted in the gap between the sheets 42 and the staple 43 by an insertion amount 48 corresponding to the staple length 45, it is possible to appropriately remove the staple 43 from the bound medium 41.

Figure 5:
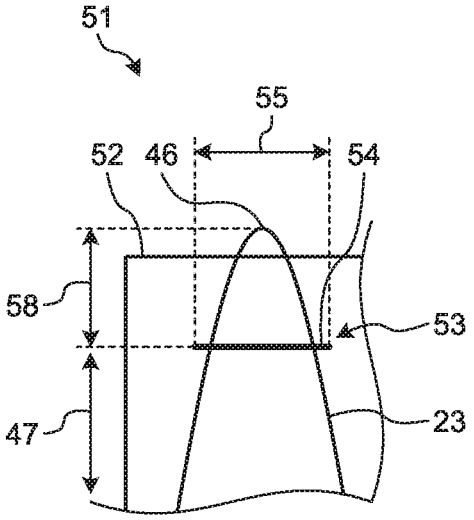
FIG. 5 is a plan view illustrating a bound medium that is bound with a large staple and the removal claw.

FIG. 5 is a plan view illustrating a bound medium 51 that is bound with a different staple 53 and the removal claw 23. As illustrated in FIG. 5, the bound medium 51 is formed by binding a plurality of sheets 52 with the staple 53. A staple length 55 indicating a length of a front portion 54 of the staple 53 along a front surface of the sheets 52 is larger than the staple length 45 of the staple 43 described above. Even when the removal claw 23 removes the staple 53 as described above from the bound medium 51, similarly to the above-described case in which the staple 43 is removed from the bound medium 41, the removal claw 23 is inserted in a gap between the front surface of the sheets 52 and the staple 53 from the tip 46. By moving the removal claw 23 away from the sheets 52 while the removal claw 23 is inserted in the gap between the sheets 52 and the staple 53 by an insertion amount 58 corresponding to the staple length 55, it is possible to appropriately remove the staple 53 from the bound medium 51. In this case, the insertion amount 58 is larger than the insertion amount 48 described above.

Figure 6:
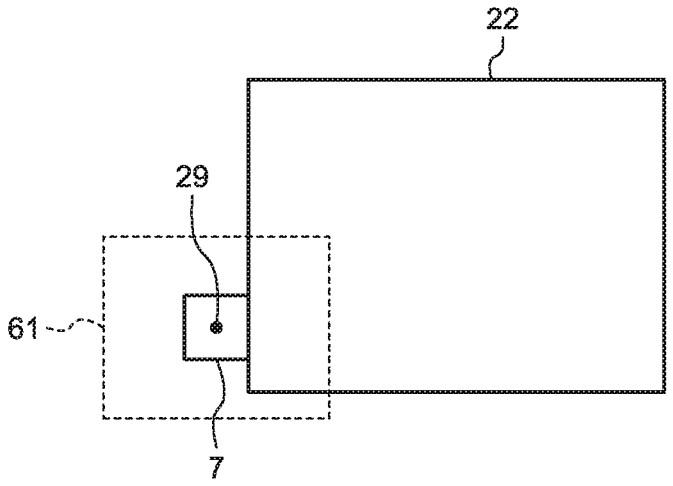
FIG. 6 is a plan view illustrating a visual field of the image capturing unit.

FIG. 6 is a plan view illustrating a visual field 61 of the image capturing unit 7. The visual field 61 of the image capturing unit 7 indicates a region that appears in an image captured by the image capturing unit 7. As illustrated in FIG. 6, the image capturing unit 7 is arranged such that the rotation axis 29 is disposed in the center of the visual field 61. Further, the image capturing unit 7 is formed so as to capture an image of a portion of the front surface of the bound medium that is conveyed through the conveying path formed by the conveying unit 2. Specifically, the image capturing unit 7 is formed such that the visual field 61 is larger than the binding region detected by the staple detecting unit 3, that is, the visual field 61 includes the entire binding region of the front surface of the bound medium. Furthermore, the image capturing unit 7 is formed such that the visual field 61 is smaller than the entire front surface of the bound medium, that is, the visual field 61 does not include a certain portion of the front surface of the bound medium.

Figure 7:
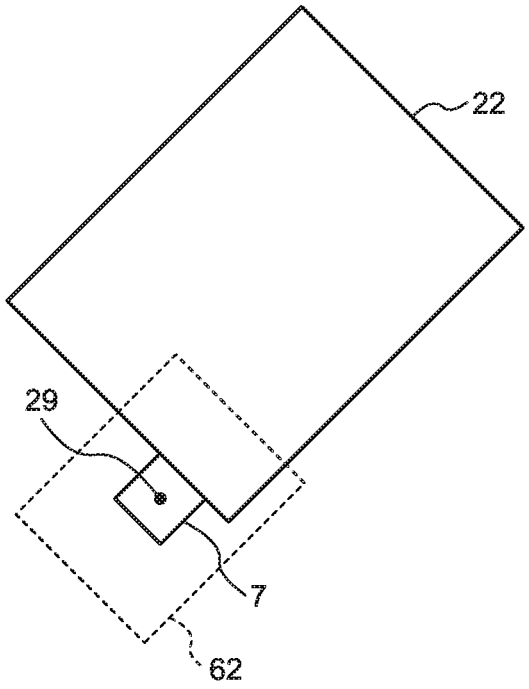
FIG. 7 is a plan view illustrating the visual field of the image capturing unit in a case where a second supporting unit rotates with respect to a first supporting unit.

FIG. 7 is a plan view illustrating a visual field 62 of the image capturing unit 7 in a case where the second supporting unit 22 rotates with respect to the first supporting unit 21. Even when the second supporting unit 22 rotates as illustrated in FIG. 7, a relative position of the visual field 62 with respect to the second supporting unit 22 does not change because the image capturing unit 7 is fixed to the second supporting unit 22, and is the same as the relative position of the visual field 61 with respect to the second supporting unit 22.

Figure 8:
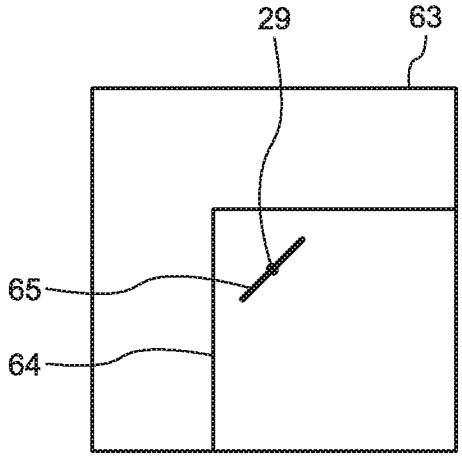
FIG. 8 is a plan view illustrating an image captured by the image capturing unit.

FIG. 8 is a plan view illustrating an image 63 captured by the image capturing unit 7. As illustrated in FIG. 8, an image 64 of a portion of the bound medium that is conveyed through the conveying path of the conveying unit 2 appears in the image 63 captured by the image capturing unit 7. The staple that binds the bound medium is disposed so as to cross the rotation axis 29. Therefore, an image 65 of the staple appears in the center of the image 63.

Figure 9:
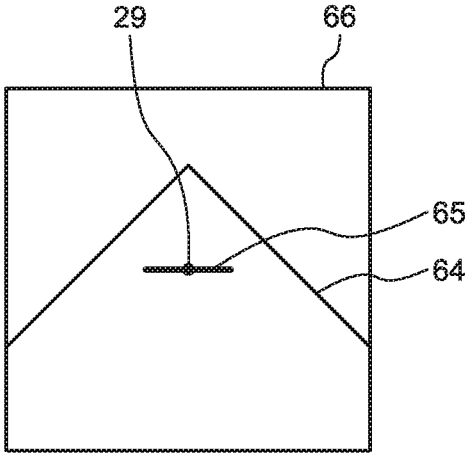
FIG. 9 is a plan view illustrating another image captured by the image capturing unit.

FIG. 9 is a plan view illustrating another image 66 captured by the image capturing unit 7. As illustrated in FIG. 9, similarly to the image 63, the image 66 is obtained by capturing an image of a portion of the bound medium, and the image 64 of the portion of the bound medium and the image 65 of the staple appear. The image 66 is captured after the image 63 is captured and after the second supporting unit 22 rotates with respect to the first supporting unit 21. In other words, a position of the second supporting unit 22 with respect to the first supporting unit 21 in a case where the image 66 is captured is different from a position of the second supporting unit 22 with respect to the first supporting unit 21 in a case where the image 63 is captured. The staple is disposed so as to cross the rotation axis 29, so that the image 65 of the staple appears in the center of the image 63.

The staple removal unit 5 is formed so as to remove the staple from the bound medium without moving the first supporting unit 21 with respect to the shaft 25 when the staple is disposed at a removal position. The removal position is a fixed position with respect to the second supporting unit 22, and is a position that crosses the rotation axis 29 in the conveying path formed by the conveying unit 2. In other words, the staple removal unit 5 is able to remove the staple from the bound medium when the second supporting unit 22 rotates with respect to the first supporting unit 21 and the removal claw 23 moves with respect to the second supporting unit 22 while the staple is arranged at the removal position.

Figure 10:
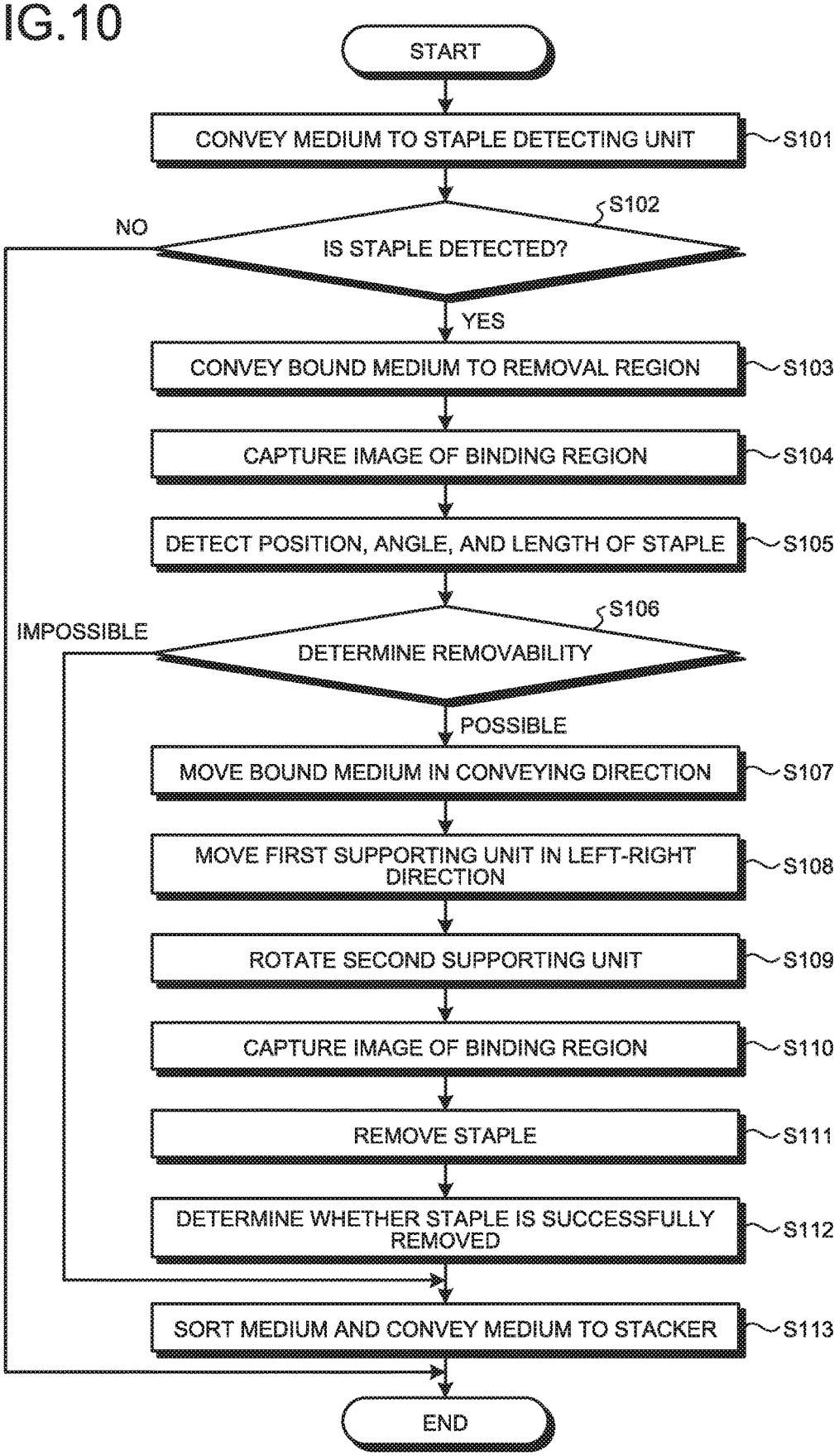
FIG. 10 is a flowchart illustrating operation performed by the binding member removal apparatus of the first embodiment.

FIG. 10 is a flowchart illustrating operation performed by the binding member removal apparatus 1 of the first embodiment. As illustrated in FIG. 10, when activated by user operation, the control unit 10 of the binding member removal apparatus 1 causes the conveying unit 2 to feed one of a plurality of media placed on the shooter of the conveying unit 2 to the conveying path of the conveying unit 2. Further, the control unit 10 causes the conveying unit 2 to convey the medium, which has been fed to the conveying path, to the staple detecting unit 3 (Step S101). When the medium is conveyed to the staple detecting unit 3, the control unit 10 causes the staple detecting unit 3 to detect whether the medium is a bound medium that is bound with a staple (Step S102).

If it is detected that the medium is the bound medium (YES at Step S102), the control unit 10 further causes the staple detecting unit 3 to detect the binding region of the bound medium in which the bound medium is bound with the staple. The binding region indicates a portion of the bound medium in which the bound medium is bound with the staple, instead of indicating the entire bound medium. In other words, the bound medium includes other regions that are not included in the binding region. When the bound medium is bound with a plurality of staples, the control unit 10 causes the staple detecting unit 3 to detect a plurality of binding regions. After the binding region is detected, the control unit 10 causes the conveying unit 2 to convey the bound medium along the conveying path of the conveying unit 2 such that the detected binding region is disposed in a removal region (Step S103). The removal region is a part of the conveying path that is formed by the conveying unit 2, and arranged near the staple removal unit 5. The staple removal unit 5 is formed so as to be able to remove the staple disposed in the removal region. After the binding region is disposed in the removal region, the control unit 10 further causes the translation driving device 31 of the removal driving unit 6 to move the second supporting unit 22 in the left-right direction 26 such that the binding region is included in the visual field of the image capturing unit 7.

After the binding region is included in the visual field of the image capturing unit 7, the control unit 10 causes the image capturing unit 7 to capture an image in which the binding region of the bound medium appears, and record the image in the storage device 12 (Step S104). After the image of the binding region of the bound medium is captured, the control unit 10 performs image processing on the image captured at Step S104 and calculates a binding position, a binding angle, and a staple length (Step S105). The control unit 10 further performs image processing on the image captured at Step S104 and determines whether it is possible to remove the staple from the bound medium by the staple removal unit 5 (Step S106).

If it is determined that it is possible to remove the staple from the bound medium (POSSIBLE at Step S106), the control unit 10 causes the conveying unit 2 to move the bound medium parallel to the conveying direction 28 such that the staple is disposed at the removal position (Step S107). Further, the control unit 10 causes the translation driving device 31 of the removal driving unit 6 to move the first supporting unit 21 parallel to the left-right direction 26 such that the staple is disposed at the removal position (Step S108). Furthermore, the control unit 10 causes the rotation driving device 32 of the removal driving unit 6 to rotate the second supporting unit 22 about the rotation axis 29 such that the longitudinal direction 47 of the removal claw 23 becomes perpendicular to the staple (Step S109). After moving the second supporting unit 22, the control unit 10 causes the image capturing unit 7 to re-capture an image in which a portion disposed in the binding region of the bound medium appears (Step S110).

After the image of the portion of the bound medium is captured, the control unit 10 causes the staple removal unit 5 to remove the staple from the bound medium (Step S111). After the staple is removed from the bound medium, the control unit 10 causes the image capturing unit 7 to capture an image in which the binding region of the bound medium appears, and determines whether the staple is appropriately removed on the basis of the captured image (Step S112).

After it is determined whether the staple is successfully removed or if it is determined that it is impossible to remove the staple from the bound medium (IMPOSSIBLE at Step S106), the control unit 10 causes the conveying unit 2 to convey the bound medium to the offset unit 8. When the bound medium is conveyed to the offset unit 8, the control unit 10 causes the offset unit 8 to place the bound medium, from which the staple is successfully removed, on the mounting surface of the stacker of the conveying unit 2 without shifting the bound medium in the horizontal direction. The control unit 10 causes the offset unit 8 to mount the bound medium, from which the staple is not successfully removed, on the mounting surface of the stacker of the conveying unit 2 while shifting the bound medium in the horizontal direction. The control unit 10, by controlling the offset unit 8, places the bound medium, from which the staple is not removed, on the mounting surface of the stacker of the conveying unit 2 while shifting the bound medium in the horizontal direction (Step S113).

The control unit 10 repeats the processes from Step S101 to Step S113 until no medium is placed on the shooter of the conveying unit 2.

Figure 11:
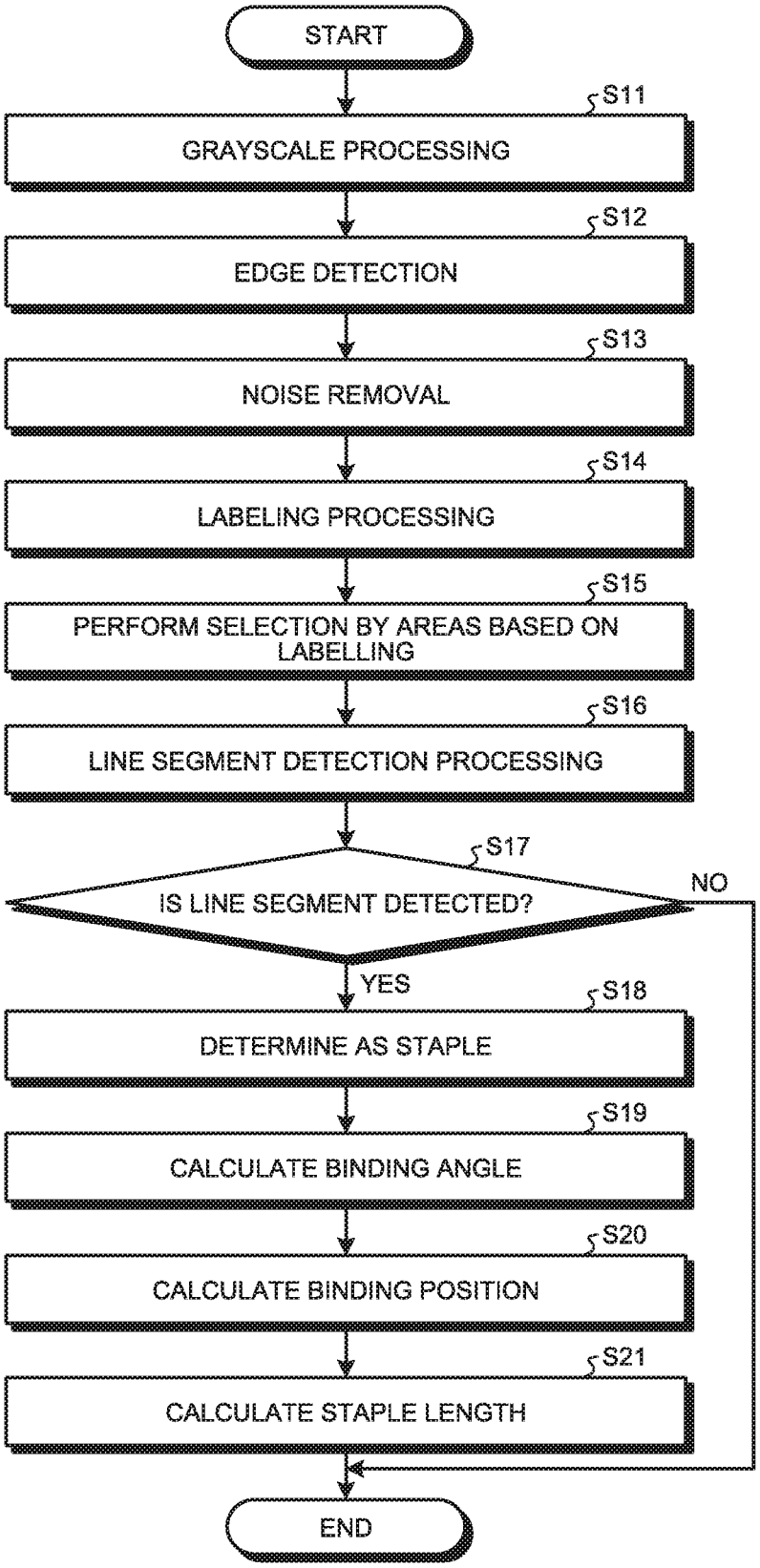
FIG. 11 is a flowchart illustrating operation of detecting a binding position, a binding angle, and a staple length.

FIG. 11 is a flowchart illustrating the operation of detecting the binding position, the binding angle, and the staple length. FIG. 11 illustrates the process at Step S105 in the flowchart of FIG. 10. When the process at Step S105 is performed, as illustrated in FIG. 11, the control unit 10 first performs grayscale processing on the image captured by the image capturing unit 7, and generates a grayscale image that is converted from the captured image (Step S11). The control unit 10 performs edge detection on the grayscale image generated at Step S11, and generates an image in which a portion of the grayscale image with a discontinuous change is identified (Step S12). The control unit 10 performs noise removal on the image generated at Step S12, and generates an image in which a portion that is not needed to detect the binding position, the binding angle, and the staple length of the staple is removed (Step S13).

The control unit 10 performs labeling processing on the image generated at Step S13, and identifies a plurality of graphics that appear in the image (Step S14). The control unit 10 selects graphics whose areas are equal to or larger than a predetermined value from among the graphics identified at Step S14 (Step S15). The control unit 10 performs line segment detection processing on the graphics selected at Step S15, and extracts a graphic that includes a line segment with a predetermined length or larger (Step S16).

If the graphic that includes the line segment with the predetermined length or larger is extracted (YES at Step S17), the control unit 10 determines that the graphic represents a staple and determines that the staple is present in the document (Step S18). If the graphic that includes the line segment with the predetermined length or larger is not extracted (NO at Step S17), the control unit 10 determines that the graphic does not represent a staple and determines that the staple is absent in the document. If it is determined that the staple is present in the document, the control unit 10 calculates the binding angle based on the graphic (Step S19), calculates the binding position based on the graphic (Step S20), and calculates the staple length (Step S21). The binding position indicates a position at which the staple is disposed in the bound medium. The binding angle indicates a direction in which the staple is oriented with respect to the bound medium. The staple length indicates a length of the front portion of the staple along the front surface of the bound medium.

Through the image processing as described above, the control unit 10 is able to appropriately detect presence or absence of a staple, and, for example, even when the staple detecting unit 3 erroneously detects a punched hole as a staple, it is possible to determine that the punched hole is not a staple. Further, through the image processing as described above, the control unit 10 is able to appropriately calculate the binding position, the binding angle, and the staple length.

Figure 12:
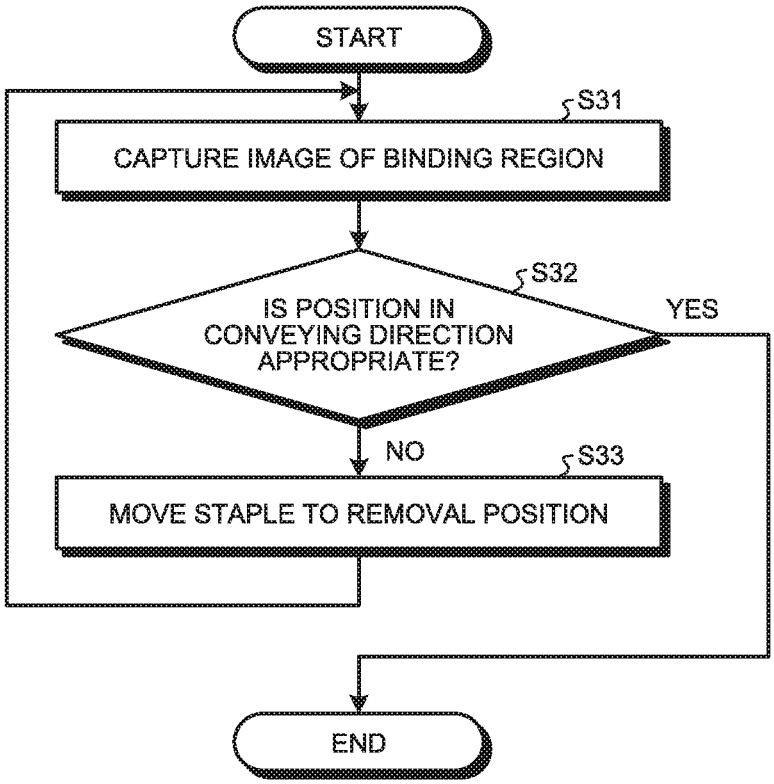
FIG. 12 is a flowchart illustrating operation of moving the bound medium in a conveying direction.

FIG. 12 is a flowchart illustrating the operation of moving the bound medium in the conveying direction 28. FIG. 12 illustrates the process at Step S107 in the flowchart of FIG. 10. When the process at Step S107 is performed, as illustrated in FIG. 12, the control unit 10 causes the image capturing unit 7 to capture an image of the binding region of the bound medium (Step S31). The control unit 10 performs image processing on the image captured at Step S31 and determines whether it is possible to dispose the binding position at the removal position without moving the bound medium parallel to the conveying direction 28 (Step S32). If it is determined that it is difficult to dispose the binding position at the removal position (NO at Step S32), the control unit 10 causes the conveying unit 2 to move the bound medium in the conveying direction 28 such that the binding position is disposed at the removal position (Step S33). After the bound medium is moved in the conveying direction 28 (Step S33), the control unit 10 causes the image capturing unit 7 to re-capture an image an image of a portion that is disposed in the binding region of the bound medium (Step S31). The control unit 10 repeats the processes from Step S31 to Step S33 until it is determined that it is possible to dispose the binding position at the removal position. If it is determined that it is possible to dispose the binding position at the removal position (YES at Step S32), the control unit 10 performs the subsequent process, i.e., the process at step S108 in the flowchart of FIG. 10 described above.

Through the operation as described above, the binding member removal apparatus 1 is able to appropriately convey the bound medium. By sequentially determining whether a conveying amount is appropriate based on a moving image, the binding member removal apparatus 1 is able to move the bound medium to an appropriate position even when the conveying unit 2 has a driving error.

Figure 13:
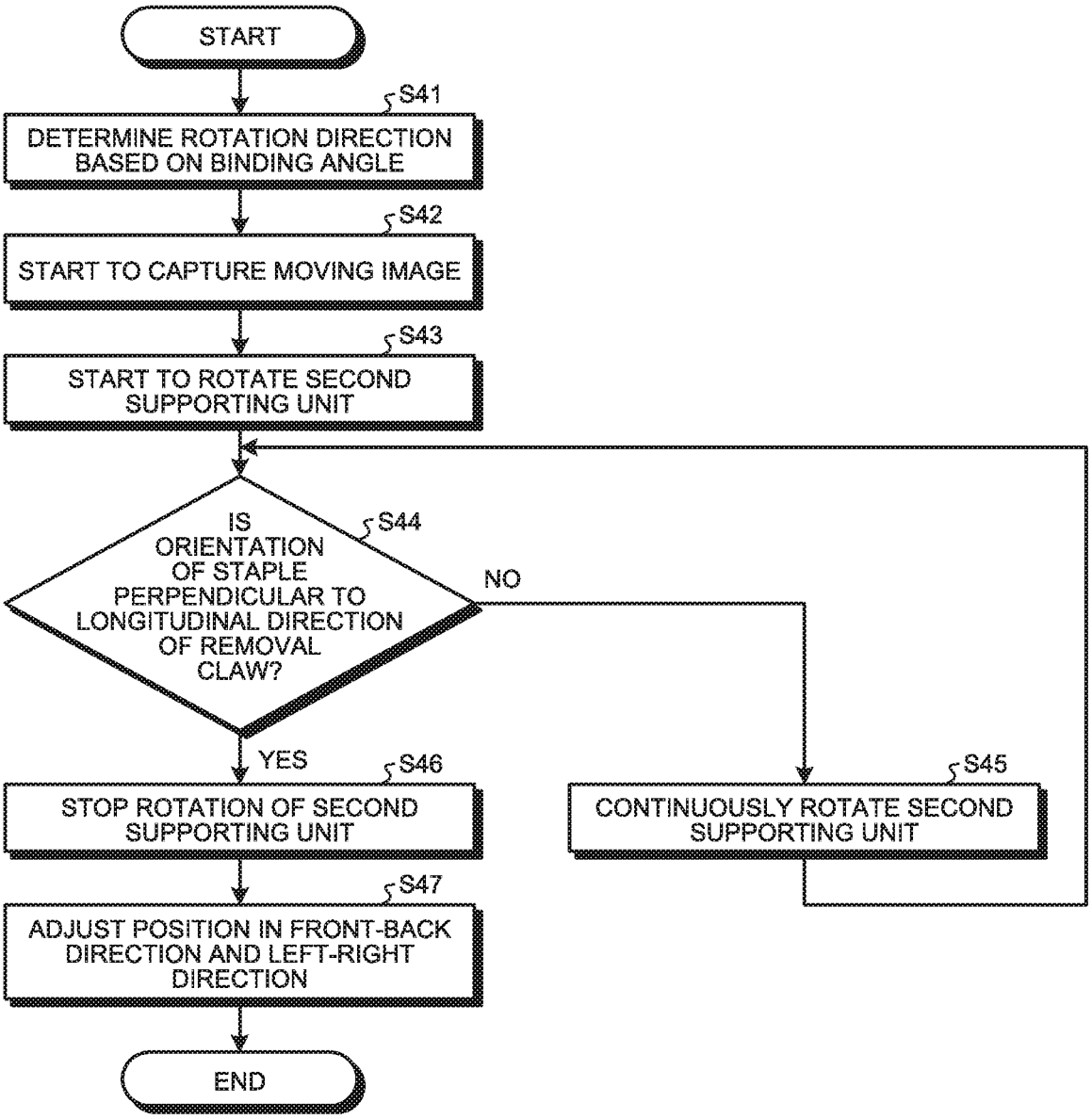
FIG. 13 is a flowchart illustrating operation of rotating the second supporting unit.

FIG. 13 is a flowchart illustrating the operation of rotating the second supporting unit 22. FIG. 13 illustrates the process at Step S109 in the flowchart of FIG. 10. When the process at Step S109 is performed, as illustrated in FIG. 13, the control unit 10 determines a direction in which the second supporting unit 22 rotates, on the basis of the binding angle calculated at Step S19 described above (Step S41). The control unit 10 causes the image capturing unit 7 to capture a moving image of the binding region, i.e., capture a still image of the binding region for each predetermined sampling time (Step S42). After the image of the binding region is captured, the control unit 10 causes the rotation driving device 32 of the removal driving unit 6 to rotate the second supporting unit 22 in the direction determined at Step S41 with respect to the first supporting unit 21 (Step S43).

After the second supporting unit 22 starts to rotate, the control unit 10 determines whether the orientation of the staple is perpendicular to the longitudinal direction 47 of the removal claw 23 on the basis of the image captured by the image capturing unit 7 (Step S44). If it is determined that the orientation of the staple is not perpendicular to the longitudinal direction 47 of the removal claw 23 (NO at Step S44), the control unit 10 causes the rotation driving device 32 of the removal driving unit 6 to continuously rotate the second supporting unit 22 (Step S45). After the rotation of the second supporting unit 22 is continued, the control unit 10 repeats the processes at Step S44 and Step S45 until it is determined that the orientation of the staple is perpendicular to the longitudinal direction 47 of the removal claw 23.

If it is determined that the orientation of the staple is perpendicular to the longitudinal direction 47 of the removal claw 23 (YES at Step S44), the control unit 10 causes the rotation driving device 32 of the removal driving unit 6 to stop the rotation of the second supporting unit 22 (Step S46).

After the rotation of the second supporting unit 22 is stopped, the control unit 10 re-adjusts a position at which the second supporting unit 22 is disposed, on the basis of the image captured by the image capturing unit 7 (Step S47). In other words, the control unit 10 performs the same process as the process at Step S107 described above, and performs the same process as the process at Step S108 described above.

Through the operation as described above, the binding member removal apparatus 1 is able to appropriately rotate the second supporting unit 22. By sequentially determining whether a moving amount is appropriate based on the moving image, the binding member removal apparatus 1 is able to rotate the second supporting unit 22 by an appropriate angle even when the rotation driving device 32 has a driving error.

Figure 14:
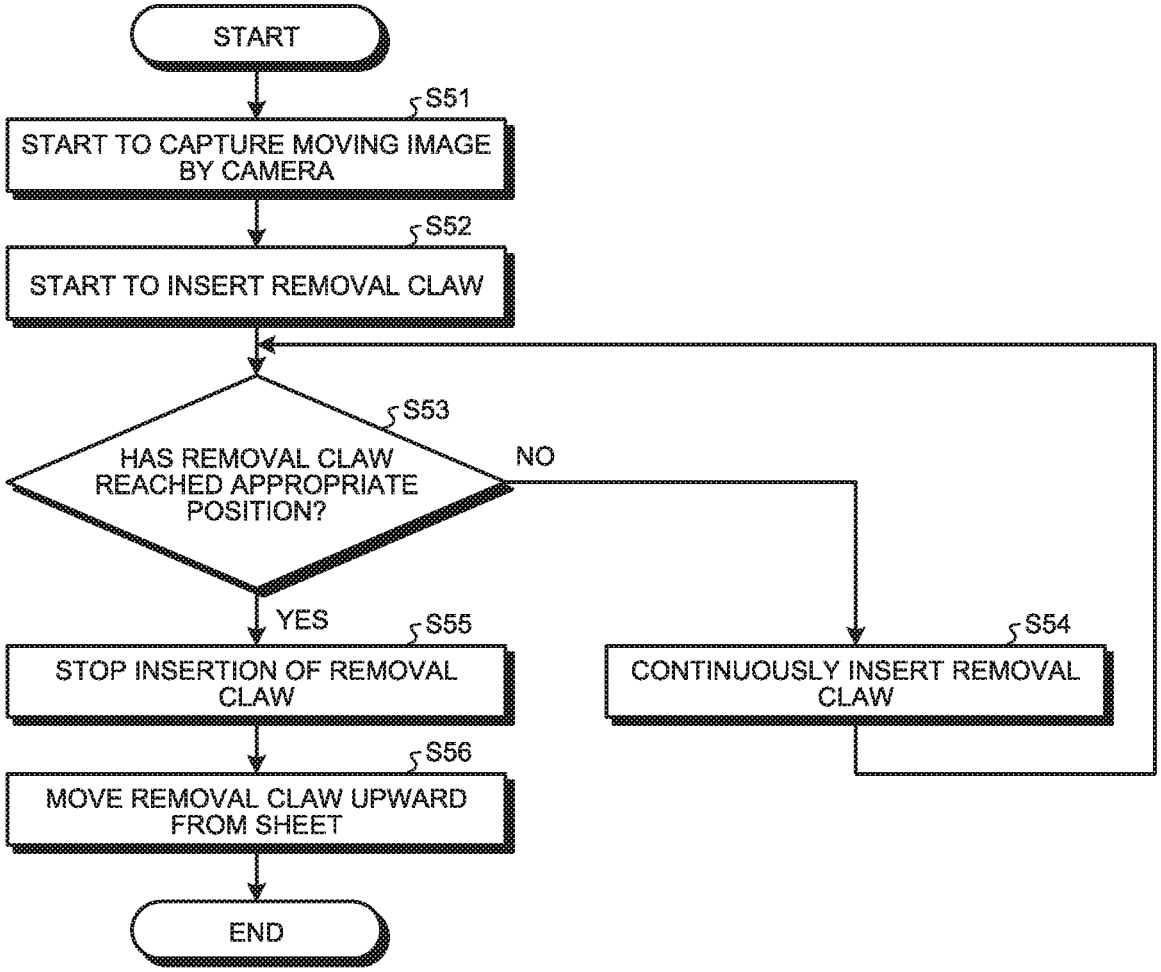
FIG. 14 is a flowchart illustrating operation of removing the staple.

FIG. 14 is a flowchart illustrating the operation of removing the staple. FIG. 14 illustrates the process at Step S111 in the flowchart of FIG. 10. When the process at Step S111 is performed, as illustrated in FIG. 14, the control unit 10 causes the image capturing unit 7 to capture a moving image of the binding region, i.e., capture a still image of the binding region for each predetermined sampling time (Step S51). After the image of the binding region is captured, the control unit 10 causes the removal claw actuator 24 of the staple removal unit 5 to move the removal claw 23 parallel to the longitudinal direction 47 of the removal claw 23 (Step S52). The removal claw 23 is inserted in the gap between the sheets of the bound medium and the staple by being moved parallel to the longitudinal direction 47.

After the removal claw 23 is inserted in the gap between the sheets of the bound medium and the staple, the control unit 10 determines whether the removal claw 23 is inserted by an appropriate insertion amount, on the basis of the image captured by the image capturing unit 7 (Step S53). If it is determined that the removal claw 23 is not inserted by the appropriate insertion amount (NO at Step S53), the control unit 10 causes the removal claw actuator 24 to continuously insert the removal claw 23 (Step S54). The control unit 10 repeats the processes at Step S53 and Step S54 until it is determined that the removal claw 23 is inserted by the appropriate insertion amount.

If it is determined that the removal claw 23 is inserted by the appropriate insertion amount (YES at Step S53), the control unit 10 causes the removal claw actuator 24 to stop the insertion of the removal claw 23 (Step S55). After the insertion of the removal claw 23 is stopped, the control unit 10 causes the removal claw actuator 24 to move the removal claw 23 away from the sheet of the bound medium (Step S56). With the movement of the removal claw 23 away from the sheets, the staple in the bound medium is removed from the bound medium.

Through the operation as described above, the binding member removal apparatus 1 is able to insert the removal claw 23 in the gap between the sheets and the staple by an appropriate insertion amount and appropriately remove the staple. By sequentially determining whether the insertion amount is appropriate on the basis of the moving image, the binding member removal apparatus 1 is able to insert the removal claw 23 by an appropriate insertion amount and appropriately remove the staple even when the removal claw actuator 24 has a driving error in moving the removal claw 23.

Figure 15:
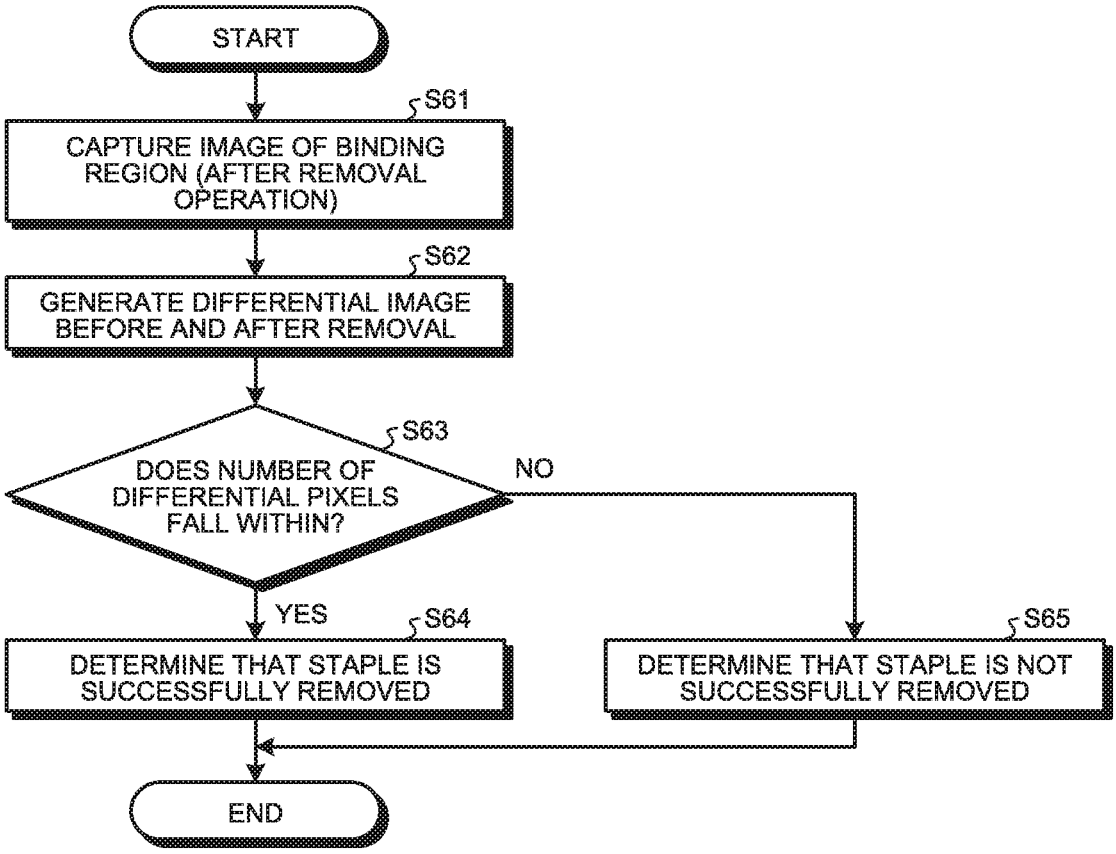
FIG. 15 is a flowchart illustrating operation of determining whether the staple is successfully removed.

FIG. 15 is a flowchart illustrating the operation of determining whether the staple is successfully removed. FIG. 15 illustrates the process at Step S112 in the flowchart of FIG. 10. When the process at Step S112 is performed, as illustrated in FIG. 15, the control unit 10 causes the image capturing unit 7 to capture an image of the binding region of the bound medium (Step S61). The control unit 10 generates a differential image based on the image captured at Step S61 and the image captured at Step S110 in the flowchart of FIG. 10 described above (Step S62).

The image captured at Step S61 is formed of a plurality of pixels that are arranged in a matrix form, and each of the pixels is colored, so that the image represents an image of an object. Similarly to the image captured at Step S61, the image captured at Step S110 is formed of a plurality of pixels that are arranged in a matrix form, and each of the pixels is colored, so that the image represents an image of the object. The differential image is formed of a plurality of pixels that are arranged in a matrix form. A pixel located at a certain position among the pixels of the differential image indicate a difference between the color of a pixel corresponding to the position among the pixels of the image captured at Step S110 and the color of a pixel corresponding to the position among the pixels of the image captured at Step S61.

The control unit 10 counts the number of differential pixels, for which the difference is larger than a predetermined threshold, among the pixels of the differential image, and determines whether the number of the differential pixels falls within a predetermined range (Step S63). If the number of the differential pixels falls within the predetermined range (YES at Step S63), the control unit 10 determines that the staple is appropriately removed from the bound medium (Step S64). If the number of the differential pixels does not fall within the predetermined range (NO at Step S63), the control unit 10 determines that the staple is not appropriately removed from the bound medium (Step S65). Through the operation as described above, the binding member removal apparatus 1 is able to appropriately determine whether the staple is appropriately removed.

Effects of Binding Member Removal Apparatus of First Embodiment

The binding member removal apparatus 1 of the first embodiment includes the staple removal unit 5, the image capturing unit 7, the removal driving unit 6, and the control unit 10. The staple removal unit 5 removes a binding member that binds a bound medium from the bound medium. The image capturing unit 7 captures an image in which a binding region that is a portion of the bound medium appears. In other words, the image capturing unit 7 captures an image of the binding region of the bound medium such that other portions different from the binding region in the bound medium do not appear in the image. The removal driving unit 6 moves the staple removal unit 5. The control unit 10 controls the removal driving unit 6 on the basis of the image such that the staple removal unit 5 is disposed at a predetermined position corresponding to a binding position at which the binding member is disposed.

The binding member removal apparatus 1 as described above is able to appropriately remove the binding member from the bound medium by moving the staple removal unit 5 on the basis of the image of the binding region of the bound medium even when the binding member is not disposed at an appropriate position with respect to the staple removal unit 5. In the binding member removal apparatus 1, the image capturing unit 7 captures an image of the binding region such that the entire bound medium does not appear in the image, so that it is possible to reduce the size of the image capturing unit 7 or arrange the image capturing unit 7 near the bound medium, as compared to other image capturing units that capture the entire bound medium. By reducing the size of the image capturing unit 7 or arranging the image capturing unit 7 near the bound medium, the binding member removal apparatus 1 is able to reduce the apparatus scale.

Further, the image capturing unit 7 of the binding member removal apparatus 1 of the first embodiment is fixed to the staple removal unit 5. In the binding member removal apparatus 1 as described above, because the image capturing unit 7 is fixed to the staple removal unit 5, the image capturing unit 7 moves together with the staple removal unit 5, so that it is possible to easily calculate, from the image, a relative position of the staple removal unit 5 with respect to the binding member.

Meanwhile, while the image capturing unit 7 of the binding member removal apparatus 1 of the first embodiment is fixed to the second supporting unit 22 of the staple removal unit 5, the image capturing unit 7 may be supported so as to be able to move with respect to the second supporting unit 22 of the staple removal unit 5. For example, the image capturing unit 7 may be supported by the second supporting unit 22 so as to be able to tilt or pan. In the binding member removal apparatus 1, even when the image capturing unit 7 is supported by the staple removal unit 5 as described above, the image capturing unit 7 moves together with the staple removal unit 5, so that it is possible to easily calculate, from the image, a relative position of the staple removal unit 5 with respect to the binding member.

Furthermore, the binding member removal apparatus 1 of the first embodiment includes the staple detecting unit 3 that detects the binding region of the bound medium in which the bound medium is bound with the binding member, and the conveying unit 2 that conveys the bound medium. In this case, the control unit 10 controls the conveying unit 2 such that the binding region is disposed in the visual field of the image capturing unit 7 before the image capturing unit 7 captures an image of the bound medium. In the binding member removal apparatus 1 as described above, the binding region of the bound medium is automatically disposed in the visual field of the image capturing unit 7, so that a user need not dispose the bound medium in the visual field of the image capturing unit 7. As a result, it is possible to easily remove the binding member from the bound medium.

Moreover, the control unit 10 of the binding member removal apparatus 1 of the first embodiment controls the conveying unit 2 such that the binding member is disposed at a predetermined removal position with respect to the staple removal unit 5, on the basis of the image captured by the image capturing unit 7.

In the binding member removal apparatus 1 as described above, the bound medium is moved parallel to the conveying direction 28 on the basis of the image of the bound medium, so that even when the removal driving unit 6 does not appropriately move the staple removal unit 5 in the conveying direction 28, it is possible to dispose the binding member at an appropriate position. The removal driving unit 6 moves the staple removal unit 5 in a single direction, such as the left-right direction 26, and therefore can be easily manufactured as compared to other removal driving devices that two-dimensionally translate the staple removal unit 5. By manufacturing the removal driving unit 6 with a small size, the binding member removal apparatus 1 is able to reduce the apparatus scale.

Furthermore, the staple removal unit 5 of the binding member removal apparatus 1 of the first embodiment includes the first supporting unit 21, the second supporting unit 22, the removal claw 23, and the removal claw actuator 24. The first supporting unit 21 is moved by the removal driving unit 6 with respect to the shaft 25 that is fixed to a frame of the binding member removal apparatus 1. The second supporting unit 22 is supported by the first supporting unit 21 so as to be able to rotate about the rotation axis 29 that is parallel to the normal direction of the bound medium. The second supporting unit 22 is rotated by the removal driving unit 6 with respect to the first supporting unit 21. The removal claw 23 is supported by the second supporting unit 22 so as to be able to move. The removal claw actuator 24 moves the removal claw 23 with respect to the second supporting unit 22. In this case, the image capturing unit 7 is fixed to the second supporting unit 22.

In the binding member removal apparatus 1 as described above, because the image capturing unit 7 is fixed to the second supporting unit 22, the image capturing unit 7 rotates together with the removal claw 23, so that it is possible to easily calculate, from the image, a degree of deviation of the insertion direction of the removal claw 23 with respect to the binding member.

Furthermore, the control unit 10 of the binding member removal apparatus 1 of the first embodiment controls the image capturing unit 7 such that an image in which the binding member appears is captured after the second supporting unit 22 rotates with respect to the first supporting unit 21. Moreover, the control unit 10 controls the removal driving unit 6 such that the second supporting unit 22 is disposed at a predetermined angle with respect to the first supporting unit 21, on the basis of the image that is captured after the second supporting unit 22 rotates.

In the binding member removal apparatus 1 as described above, the second supporting unit 22 is further rotated on the basis of the image that is captured after the second supporting unit 22 rotates, so that it is possible to orient the removal claw 23 at an appropriate angle and appropriately remove the binding member.

Moreover, the control unit 10 of the binding member removal apparatus 1 of the first embodiment controls the removal claw actuator 24 such that the removal claw 23 is inserted in the gap between the bound medium and the binding member by the calculated insertion amount, on the basis of the image captured by the image capturing unit 7.

In the binding member removal apparatus 1 as described above, the removal claw 23 is inserted in the binding member on the basis of the image, so that it is possible to insert the removal claw 23 in the binding member by the insertion amount corresponding to the size of the binding member, and appropriately remove the binding member with a different size from the bound medium.

Furthermore, the control unit 10 of the binding member removal apparatus 1 of the first embodiment controls the image capturing unit 7 such that an image in which the bound medium appears is captured after the removal claw 23 is inserted in the gap between the bound medium and the binding member. The control unit 10 controls the removal claw actuator 24 such that the removal claw 23 is inserted in the gap between the bound medium and the binding member by a different insertion amount that is calculated based on the image that is captured after the removal claw 23 is inserted.

In the binding member removal apparatus 1 as described above, the insertion amount by which the removal claw 23 is inserted is finely adjusted while capturing images, so that even when a driving error in moving the removal claw 23 is present, it is possible to appropriately insert the removal claw 23 and appropriately remove the binding member from the bound medium.

Moreover, the control unit 10 of the binding member removal apparatus 1 of the first embodiment controls the image capturing unit 7 such that a post-removal image in which the bound medium appears is captured after the staple removal unit 5 removes the binding member from the bound medium.

In the binding member removal apparatus 1 as described above, by capturing the image of the bound medium from which the binding member is removed, it is possible to compare states of the binding region of the bound medium before and after the removal, and determine whether the binding member is appropriately removed from the bound medium.

Furthermore, the binding member removal apparatus 1 of the first embodiment includes the offset unit 8. The offset unit 8 sorts a plurality of bound media that are conveyed from the staple detecting unit 3 to the staple removal unit 5 by the conveying unit 2 into a plurality of types, and holds the bound media in a sorted manner on the stacker of the conveying unit 2. In this case, the control unit 10 determines whether the binding member is successfully removed, on the basis of the image that is captured before the binding member is removed and the image that is captured after the binding member is removed. The control unit 10 controls the offset unit 8 such that the bound medium for which it is determined that the binding member is successfully removed and the bound medium for which it is determined that the binding member is not successfully removed are sorted into different types and held on the stacker of the conveying unit 2 in a sorted manner.

In the binding member removal apparatus 1 as described above, the bound media are held on the stacker of the conveying unit 2 after the bound medium are sorted into those from which the binding member is successfully removed and those from which the binding member is not successfully removed, so that a user can easily perform operation of removing the binding member from the bound medium from which the binding member is not successfully removed. In the binding member removal apparatus 1, by holding the bound medium on the stacker of the conveying unit 2 by sorting them into those from which the binding member is successfully removed and those from which the binding member is not successfully removed, it is possible to remove the binding member from the bound media at a high speed without stopping operation every time the binding member is not successfully removed.

Meanwhile, while the offset unit 8 of the binding member removal apparatus 1 of the first embodiment sorts the media to be placed on the mounting surface of the stacker of the conveying unit 2 by shifting the media in the horizontal direction, it may be possible to sort the media by a different method. For example, the offset unit 8 may be replaced with a different sorting unit that puts a tag on a bound medium from which a staple is not successfully removed. Even when the binding member removal apparatus 1 is provided with the sorting unit as described above, a user can easily perform operation of removing the binding member from the bound medium from which the binding member is not successfully removed. The offset unit 8 may be omitted from the binding member removal apparatus 1 of the first embodiment. Even when the offset unit 8 is omitted from the binding member removal apparatus 1, it is possible to reduce the apparatus scale by reducing the size of the image capturing unit 7 or disposing the image capturing unit 7 near the bound medium.

Furthermore, the control unit 10 of the binding member removal apparatus 1 of the first embodiment determines whether the binding member is removable on the basis of the image captured by the image capturing unit 7. In this case, the control unit 10 controls the staple removal unit 5 such that the binding member is removed from the bound medium for which it is determined that the binding member is removable. The control unit 10 controls the staple removal unit 5 such that the binding member is not removed from the bound medium for which it is determined that the binding member is not removable. In the binding member removal apparatus 1 as described above, it is possible to prevent a defect, such as a failure, by preventing the binding member from being removed when it is determined that the binding member is not removable.

Figure 16:
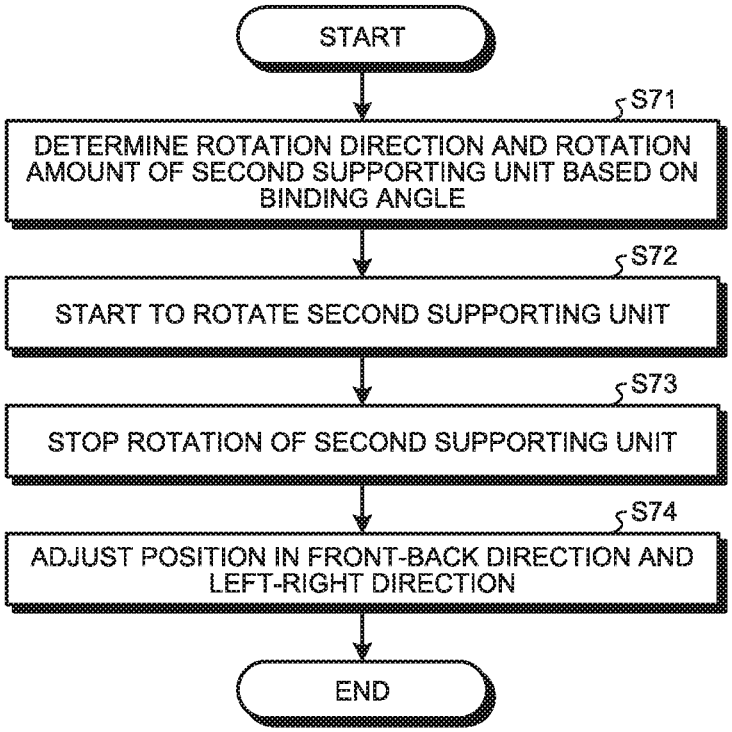
FIG. 16 is a flowchart illustrating a modification of the operation of rotating a second supporting unit 22.

Meanwhile, while the binding member removal apparatus 1 of the first embodiment further rotates the second supporting unit 22 on the basis of the image that is captured after the second supporting unit 22 rotates, it may be possible to omit operation of capturing an image during rotation of the second supporting unit 22. FIG. 16 is a flowchart illustrating a modification of the operation of rotating the second supporting unit 22 (Step S109). When the process at Step S109 described above is performed, as illustrated in FIG. 16, the control unit 10 determines a rotation direction and a rotation amount of the second supporting unit 22 on the basis of the binding angle calculated at Step S19 described above (Step S71).

The control unit 10 causes the rotation driving device 32 of the removal driving unit 6 to rotate the second supporting unit 22 in the direction determined at Step S71 with respect to the first supporting unit 21 (Step S72). The control unit 10 causes the rotation driving device 32 of the removal driving unit 6 to stop rotation of the second supporting unit 22 after the second supporting unit 22 rotates by the rotation amount determined at Step S71 (Step S73).

After the rotation of the second supporting unit 22 is stopped, the control unit 10 re-adjusts a position at which the second supporting unit 22 is disposed, on the basis of the image captured by the image capturing unit 7 (Step S74). In other words, the control unit 10 performs the same process as the process performed at Step S107 described above, and performs the same process as the process performed at Step S108 described above.

Through the operation as described above, even when the operation of capturing an image is omitted during rotation of the second supporting unit 22, the binding member removal apparatus 1 is able to appropriately rotate the second supporting unit 22 and appropriately remove the staple from the bound medium.

Figure 17:
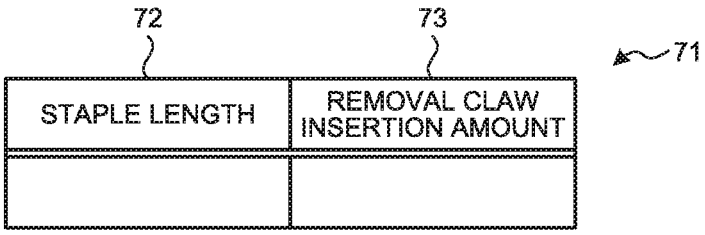
FIG. 17 is a diagram illustrating an insertion amount table 71.

Meanwhile, while the binding member removal apparatus 1 of the first embodiment further inserts the removal claw 23 on the basis of the image that is captured after the removal claw 23 is inserted in the gap between the bound medium and the staple, it may be possible to omit operation of capturing the image during insertion of the removal claw 23. For example, an insertion amount table is recorded in advance in the storage device 12 of the control unit 10. FIG. 17 is a diagram illustrating an insertion amount table 71. As illustrated in FIG. 17, the insertion amount table 71 associates a plurality of staple lengths 72 with a plurality of removal claw insertion amounts 73. In other words, an arbitrary element of the staple lengths 72 is associated with one element of the removal claw insertion amounts 73. Each element of the staple lengths 72 indicates a length. Each element of the removal claw insertion amounts 73 indicates an insertion amount.

Figure 18:
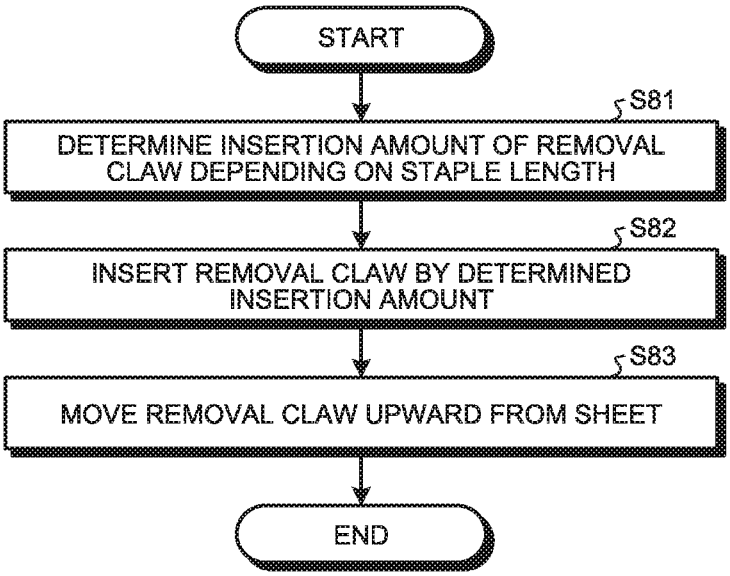
FIG. 18 is a flowchart illustrating a modification of the operation of removing the staple.

FIG. 18 is a flowchart illustrating a modification of the operation of removing the staple (Step S111). When the process at Step S111 described above is performed, as illustrated in FIG. 18, the control unit 10 refers to the insertion amount table 71, and extracts an element indicating the staple length calculated at Step S21 from the staple lengths 72. The control unit 10 determines an insertion amount by extracting an element corresponding to the extracted element from the removal claw insertion amounts 73 (Step S81). In other words, the insertion amount is equal to the insertion amount indicated by the element extracted from the staple lengths 72.

The control unit 10 causes the removal claw actuator 24 to insert the removal claw 23 in the gap between the sheets of the bound medium and the staple by the determined insertion amount (Step S82). After the removal claw 23 is inserted by the determined insertion amount, the control unit 10 causes the removal claw actuator 24 to move the removal claw 23 away from the sheets of the bound medium (Step S83). The staple in the bound medium is removed from the bound medium by moving the removal claw 23 away from the sheets.

Through the operation as described above, even when the operation of capturing an image during insertion of the removal claw 23 is omitted, the binding member removal apparatus 1 is able to appropriately insert the removal claw 23 by an appropriate insertion amount and appropriately remove the staple.

Figure 19:
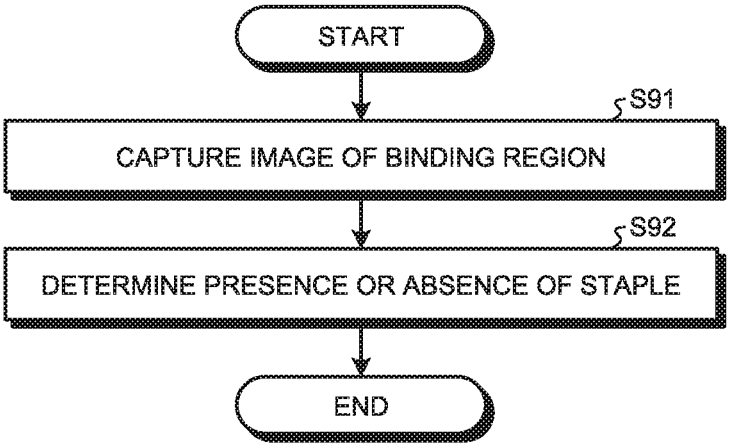
FIG. 19 is a flowchart illustrating a modification of the operation of determining whether the staple is successfully removed.

Meanwhile, while the binding member removal apparatus 1 of the first embodiment determines whether the staple is successfully removed by comparing the images of the binding region that are captured before and after the staple is removed, it may be possible to determine whether the staple is successfully removed by other methods. FIG. 19 is a flowchart illustrating a modification of the operation of determining whether the staple is successfully removed (Step S112). When the process at Step S112 described above is performed, as illustrated in FIG. 19, the control unit 10 first causes the image capturing unit 7 to capture an image of the binding region of the bound medium (Step S91). The control unit 10 performs image processing on the image captured at Step S91 and determines whether a staple is present or absent in the binding region (Step S92). Examples of the image processing as described above include the processes from Step S11 to Step S18 in the flowchart of FIG. 11 described above. The control unit 10 determines that the staple is successfully removed from the bound medium when the staple is absent in the binding region, and determines that the staple is not successfully removed from the bound medium when the staple is present in the binding region.

Through the operation as described above, the binding member removal apparatus 1 is able to appropriately determine whether the staple is successfully removed, without using the image captured at Step S110 described above, so that it is possible to omit the process at Step S110.

Second Embodiment

Figure 20:
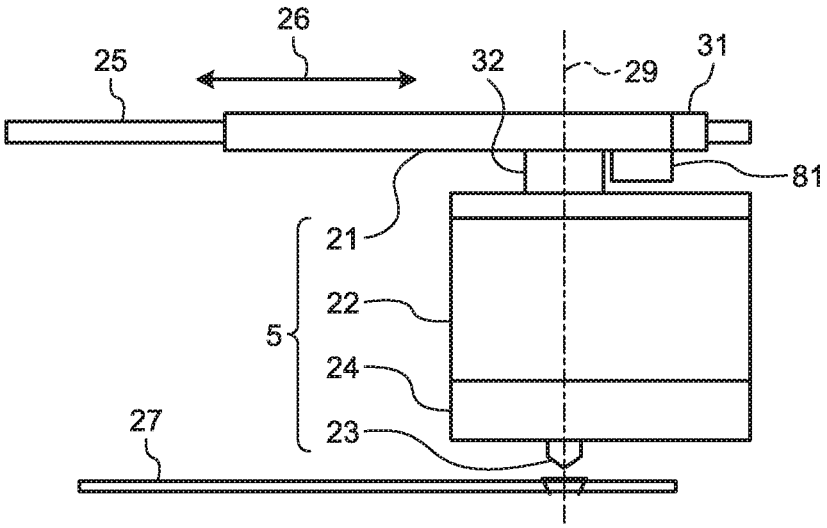
FIG. 20 is a front view illustrating an image capturing unit of a binding member removal apparatus of a second embodiment.
Figure 21:
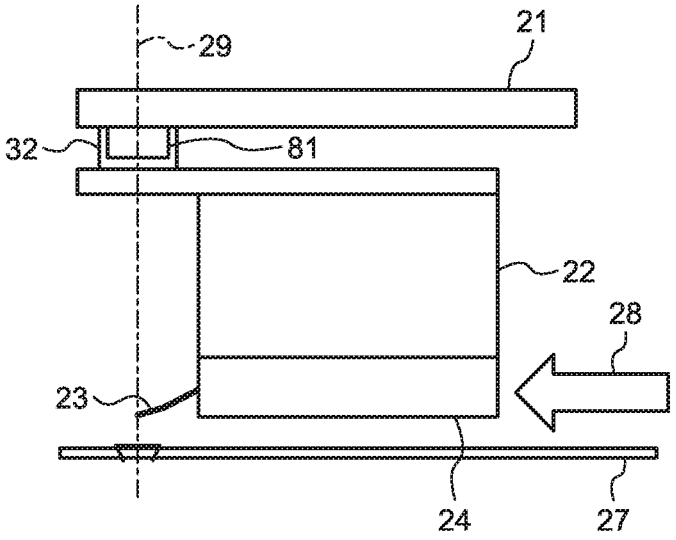
FIG. 21 is a side view illustrating the image capturing unit of the binding member removal apparatus of the second embodiment.

FIG. 20 is a front view illustrating an image capturing unit 81 of a binding member removal apparatus of a second embodiment. FIG. 21 is a side view illustrating the image capturing unit 81 of the binding member removal apparatus of the second embodiment. The binding member removal apparatus of the second embodiment includes the image capturing unit 81 that is different from the image capturing unit 7 of the binding member removal apparatus 1 of the first embodiment described above. The image capturing unit 81 is arranged such that even when the second supporting unit 22 rotates within a predetermined range (for example, in a range of 180 degrees) with respect to the first supporting unit 21, a portion that crosses the rotation axis 29 in the bound medium 27 conveyed by the conveying unit 2 appears in the center of a screen. Further, the image capturing unit 81 is arranged such that even when the second supporting unit 22 rotates within the predetermined range with respect to the first supporting unit 21, an image in which the tip of the removal claw 23 appears is captured. The image capturing unit 81 is supported by the first supporting unit 21 and fixed to the first supporting unit 21.

Figure 22:
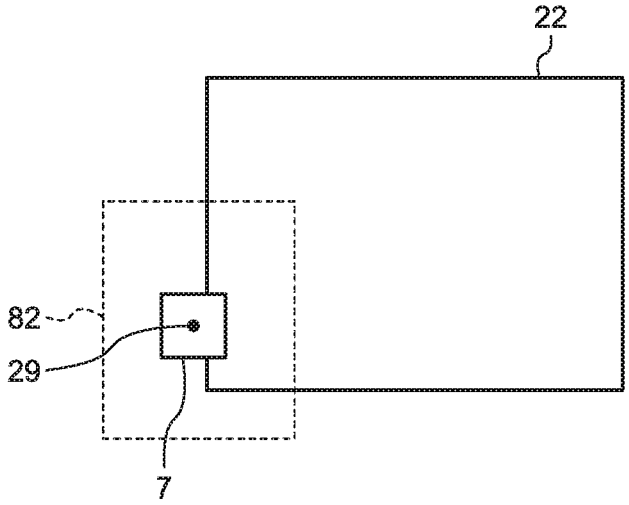
FIG. 22 is a plan view illustrating a visual field of the image capturing unit.
Figure 23:
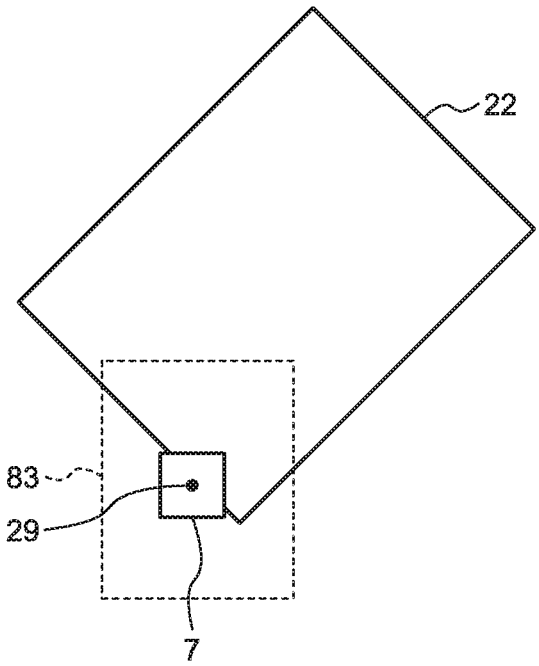
FIG. 23 is a plan view illustrating the visual field of the image capturing unit in a case where a second supporting unit rotates with respect to a first supporting unit.

FIG. 22 is a plan view illustrating a visual field 82 of the image capturing unit 81. As illustrated in FIG. 22, the image capturing unit 81 is arranged such that the rotation axis 29 is disposed in the center of a visual field 82 of the image capturing unit 81. FIG. 23 is a plan view illustrating a visual field 83 of the image capturing unit 81 in a case where the second supporting unit 22 rotates with respect to the first supporting unit 21. As illustrated in FIG. 23, the rotation axis 29 is continuously disposed in the center of the visual field 83 even when the second supporting unit 22 rotates because the image capturing unit 81 is fixed to the first supporting unit 21.

Even in the binding member removal apparatus of the second embodiment, because the image capturing unit 81 is fixed to the first supporting unit 21, the image capturing unit 7 moves together with the first supporting unit 21, so that it is possible to easily calculate, from the image, a relative position at which the staple removal unit 5 is disposed with respect to the binding member.

Furthermore, the image capturing units 7 and 81 may be replaced with a different image capturing unit that is supported by and fixed to the removal claw 23. Even in this case, in the binding member removal apparatus, the image capturing unit moves together with the staple removal unit 5, so that it is possible to easily calculate, from the image, a relative position at which the staple removal unit 5 is disposed with respect to the binding member.

Meanwhile, while the image capturing units 7 and 81 described above are fixed to a part of the staple removal unit 5, the image capturing units 7 and 81 need not always be fixed to the staple removal unit 5. For example, the image capturing unit 7 or the image capturing unit 81 may be replaced with a different image capturing unit that is fixed to the shaft 25. Such an image capturing unit captures an image of a portion of the bound medium that is disposed in the removal region, instead of capturing the entire image of the bound medium. Even in the binding member removal apparatus that includes the image capturing unit as described above, it is possible to reduce the size of the image capturing unit or arrange the image capturing unit near the bound medium similarly to the binding member removal apparatus as described above, so that it is possible to reduce the apparatus scale.

Meanwhile, while the translation driving device 31 of the removal driving unit 6 moves the first supporting unit 21 parallel to the left-right direction 26, it may be possible to translate the first supporting unit 21 in a certain direction that is not parallel to the left-right direction 26. The certain direction is parallel to the surface of the bound medium 27 conveyed by the conveying unit 2 and is not parallel to the conveying direction 28. Even in this case, the binding member removal apparatus is able to dispose the removal claw 23 at an arbitrary position in the removal region, so that it is possible to appropriately remove the staple disposed in the removal region.

Furthermore, while the translation driving device 31 of the removal driving unit 6 moves the first supporting unit 21 parallel to a single direction, it may be possible to two-dimensionally translate the first supporting unit 21. Even in this case, the binding member removal apparatus is able to dispose the removal claw 23 at an arbitrary position in the removal region, and appropriately remove the staple disposed in the removal region. In this case, the conveying unit 2 conveys the medium from the shooter until the binding region is disposed in the removal region, and conveys the medium to the stacker after the staple is removed, but the conveying unit 2 need not always be used to adjust the binding position to the removal position. For example, the binding member removal apparatus is able to replace the process performed at Step S107 as described above with a process of adjusting the binding position to the removal position by moving the first supporting unit 21 in the conveying direction 28.

Meanwhile, while the binding member removal apparatus of the embodiments described above includes the conveying unit 2 and the staple detecting unit 3, if the translation driving device 31 is able to two-dimensionally translate the first supporting unit 21, it may be possible to omit the conveying unit 2 and the staple detecting unit 3. Even in this case, a user moves the bound medium such that a staple that binds the bound medium is disposed in the removal region. When the staple is disposed in the removal region, the binding member removal apparatus removes the staple from the bound medium by performing the processes from Step S103 to Step S112 described above. After the staple is removed from the bound medium, the user collects the bound medium. Even in this case, the binding member removal apparatus is able to reduce the apparatus scale by reducing the size of the image capturing unit or disposing the image capturing unit near the bound medium.

Meanwhile, the staple may be replaced with a different binding member that binds a plurality of sheets. Examples of the binding member include a paper portion that is cut and turned up in the paper of a document. Even the binding member as described above can be removed by the binding member removal apparatus described above, similarly to the staple. In the binding member removal apparatus as described above, even when the binding member as described above is to be removed, it is possible to reduce the apparatus scale by reducing the sizes of the image capturing units 7 and 81 or disposing the image capturing units 7 and 81 near the bound medium.

The binding member removal apparatus of the disclosed technology can be downsized.

All examples and conditional language recited herein are intended for pedagogical purposes of aiding the reader in understanding the disclosure and the concepts contributed by the inventor to further the art, and are not to be construed as limitations to such specifically recited examples and conditions, nor does the organization of such examples in the specification relate to a showing of the superiority and inferiority of the disclosure. Although the embodiments of the disclosure have been described in detail, it should be understood that the various changes, substitutions, and alterations could be made hereto without departing from the spirit and scope of the disclosure.

What is claimed is:

1. A binding member removal apparatus comprising:

a remover configured to remove a binding member that binds a bound medium from the bound medium;

an image capturer configured to capture an image in which a portion of the bound medium appears;

a driver configured to move the remover; and a controller configured to control the driver such that the remover is disposed at a predetermined position with respect to the binding member, on the basis of the image, wherein the remover includes:

a first supporter;

a second supporter configured to be supported by the first supporter so as to be able to rotate about a rotation axis that is parallel to a normal direction of the bound medium;

a removal claw configured to be supported by the second supporter so as to be able to move; and a removal claw driver configured to drive the removal claw with respect to the second supporter, and the image capturer is fixed to the second supporter.

2. The binding member removal apparatus according to claim 1, wherein the image capturer is supported by the remover.

3. The binding member removal apparatus according to claim 2, wherein the image capturer is fixed to the remover.

4. The binding member removal apparatus according to claim 1, further comprising:

a detector configured to detect a binding region of the bound medium in which the bound medium is bound with the binding member; and a conveyor configured to convey the bound medium, wherein the controller controls the conveyor such that the binding region is disposed in a predetermined region with respect to the image capturer before the image of the bound medium is captured.

5. The binding member removal apparatus according to claim 4, wherein the controller controls the conveyor such that the binding member is disposed at a predetermined position with respect to the remover, on the basis of the image.

6. The binding member removal apparatus according to claim 4, wherein the controller controls the image capturer such that a post-removal image in which the bound medium appears is captured after the remover removes the binding member from the bound medium.

7. The binding member removal apparatus according to claim 6, further comprising:

a stacker; and a sorting unit that sorts sorter configured to sort a plurality of bound media that are conveyed from the detecting unit detector to the remover by the conveyor into first media and a second media, and holds the bound media in a sorted manner on the stacker, wherein the controller determines whether the binding member is successfully removed on the basis of the image and the post-removal image, and controls the sorter such that the bound medium is sorted into the first medium when it is determined that the binding member is successfully removed, and such that the bound medium is sorted into the second medium when it is determined that the binding member is not successfully removed.

8. The binding member removal apparatus according to claim 1, wherein the controller controls the image capturer such that a post-rotation image in which the binding member appears is captured after the second supporter rotates with respect to the first supporter, and controls the driver such that the second supporter is disposed at a predetermined angle with respect to the first supporter, on the basis of the post-rotation image.

9. The binding member removal apparatus according to claim 1, wherein the controller controls the removal claw driver such that the removal claw is inserted in a gap between the bound medium and the binding member by an insertion amount that is calculated based on the image.

10. The binding member removal apparatus according to claim 9, wherein the controller controls the image capturer such that a post-insertion image in which the bound medium appears is captured after the removal claw is inserted in the gap between the bound medium and the binding member, and controls the removal claw driver such that the removal claw is inserted in the gap between the bound medium and the binding member by a different insertion amount that is calculated based on the post-insertion image.

11. The binding member removal apparatus according to claim 1, wherein the controller determines whether the binding member is removable on the basis of the image, and controls the remover such that the binding member is removed from the bound medium when it is determined that the binding member is removable, and such that the bound medium is not removed from the bound medium when it is determined that the binding member is not removable.

12. A binding member removal apparatus comprising:

a remover configured to remove a binding member that binds a bound medium from the bound medium;

an image capturer configured to capture an image in which a portion of the bound medium appears;

a driver configured to move the remover;

a controller configured to control the driver such that the remover is disposed at a predetermined position with respect to the binding member, on the basis of the image, a detector configured to detect a binding region of the bound medium in which the bound medium is bound with the binding member; and a conveyor configured to convey the bound medium, wherein the controller controls the conveyor such that the binding region is disposed in a predetermined region with respect to the image capturer before the image of the bound medium is captured, and the controller controls the image capturer such that a post-removal image in which the bound medium appears is captured after the remover removes the binding member from the bound medium.

* * * * *